United States Patent [19]

Evans

[11] 4,187,508

[45] Feb. 5, 1980

[54] REFLECTOR ANTENNA WITH PLURAL FEEDS AT FOCAL ZONE

[75] Inventor: Gary E. Evans, Baltimore, Md.

[73] Assignee: Westinghouse Electric Corp., Pittsburgh, Pa.

[21] Appl. No.: 956,779

[22] Filed: Nov. 1, 1978

Related U.S. Application Data

[63] Continuation of Ser. No. 722,260, Sep. 10, 1976, abandoned.

[51] Int. Cl.[2] ..... H01Q 19/14

[52] U.S. Cl. ..... 343/770; 343/779; 343/835

[58] Field of Search ..... 343/770, 771, 779, 854, 343/835, 840

[56] References Cited

U.S. PATENT DOCUMENTS

| | | | |
|---|---|---|---|
| 3,500,411 | 3/1970 | Kiesling | 343/835 |
| 3,665,481 | 5/1972 | Low | 343/777 |
| 3,815,140 | 6/1974 | Buehler et al. | 343/779 |
| 3,990,079 | 11/1976 | Epis | 343/771 |

FOREIGN PATENT DOCUMENTS

| | | | |
|---|---|---|---|
| 814355 | 6/1959 | United Kingdom | 343/779 |

*Primary Examiner*—Eli Lieberman
*Attorney, Agent, or Firm*—H. W. Patterson

[57] ABSTRACT

An antenna assembly with a curved reflector and feed means at one side of the focal axis of such reflector. The feed means includes a number of relatively-fixed-position feed elements spaced apart unequally to obtain signals of different phase at the reflector for forming a composite reflected beam with minimized sidelobe content.

4 Claims, 8 Drawing Figures

REFLECTOR ANTENNA WITH PLURAL FEEDS AT FOCAL ZONE

This a continuation of application Ser. No. 722,260, filed Sept. 10, 1976, now abandoned.

BACKGROUND OF THE INVENTION

1. Field of the Invention

Reflected beam antenna assemblies.

2. Description of the Prior Art

Design situations occur in which it is desirable to utilize a single beam-forming reflector with two different simultaneously available feed means. It would seem logical to place one feed means beside the other, but this tends to degrade the utility of the main beam by producing large sidelobes during transmission and imperfection in focusing during reception.

Techniques for cancelling or reducing the sidelobes of an antenna system exist in the form of electronic circuitry, but this tends to add complexity and cost to the system and is of limited effectiveness. A preliminary novelty search conducted in the United States Patent and Trademark Office with respect to the present invention has uncovered the following U.S. Pat. Nos.: 3,290,684; 3,412,405; 3,435,453; 3,495,249; 3,568,193; 3,763,490; 3,900,874; 3,916,325; and 3,938,153. All of these patents except No. 3,763,490, disclose forms of cancellation and suppression of sidelobes by circuitry techniques. The U.S. Pat. No. 3,763,490 deals with beam forming rather than sidelobe control. None of these patents relate to solving an offset-feed sidelobe problem for which cancellation techniques alone are inadequate.

SUMMARY OF THE INVENTION

The present invention affords opportunity for an offset fed antenna system that provides an electromagnetic wave energy beam with less sidelobe content than heretofore available in advance of any cancellation by specialized circuitry.

DESCRIPTION OF THE PREFERRED EMBODIMENT

Figure 1:
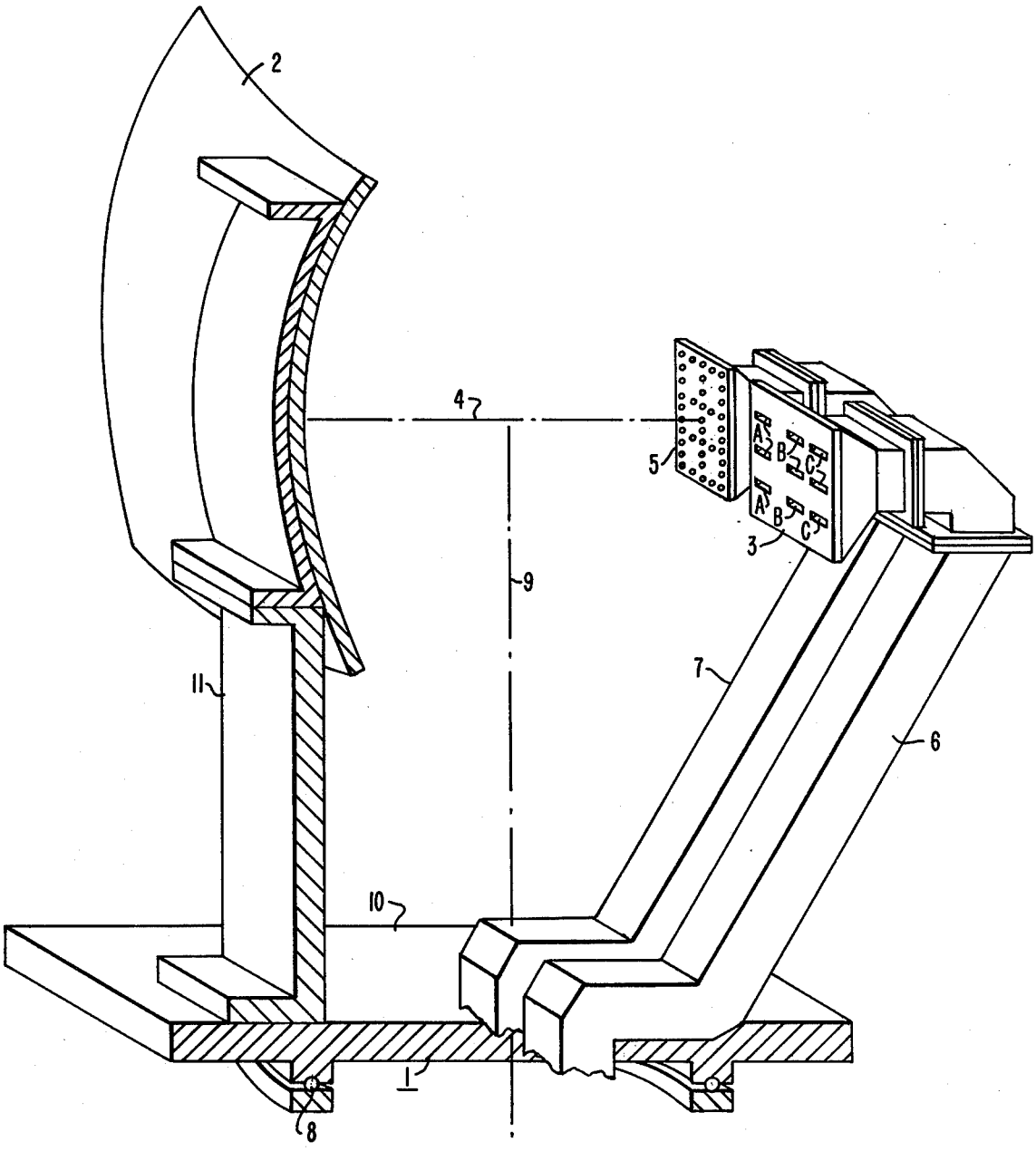
FIG. 1 is a three-dimensional elevation view, partly in outline and partly in section, of a dual feed antenna system embodying the sidelobe-reducing offset feed means of the present invention.

Referring to FIG. 1, the antenna assembly 1 of the present invention comprises a reflector 2 of parabolic shape, for example, for reflecting electromagnetic wave energy from at least one feed means 3 offset laterally from the focal axis 4 of the reflector and, according to one aspect of the present invention, also from a second feed means 5 located on such axis. Both feed means 3 and 5 may be of the slot type as shown, but the invention applies equally well with horn and dipole types, not shown. These feed means are affiliated with transmission line means such as wave guide means 6 and 7, as shown, respectively, for transmission of the electromagnetic wave energy to and from the feed means. The assembly usually will be located atop a tower and supported by rotary bearing means 8 for turning movement about a vertical axis 9. The source of the energy for the antenna feed means 3 and 5 and the drive motor means for the platform 10 on which the assembly is mounted are not shown in the drawing. A pedestal 11 supports the parabolic reflector 2 on platform 10, and the feed means 3 and 5 are shown as finding support from the waveguides 6 and 7, but obviously other independent support for such feed means may be provided, and usually would be.

The on-axis feed means 5 is straightforward in its use and introduces no complexity that isn't taken care of by well known prior art techniques.

Figure 4:
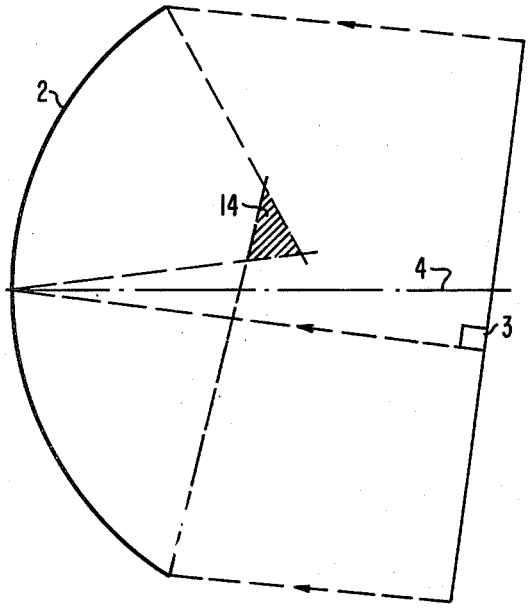
FIGS. 4 and 5 depict schematically in plan view the type of distortion that arises from an off-axis fed parabolic antenna reflector in the receiving and transmitting modes, respectively.
Figure 5:
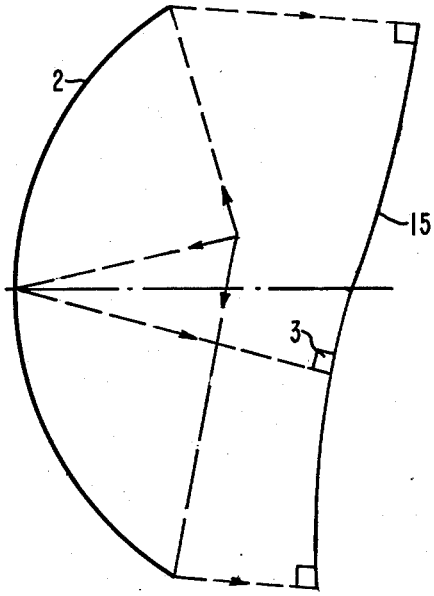

Referring to FIG. 4, the off-axis feed means 3 in the receive mode tends to result in an imperfect focus indicated schematically by the cross-hatch area 14, and referring to FIG. 5, equivalently to result in a curved wave front 15 tending to create large sidelobes in the transmitting mode.

Figure 2:
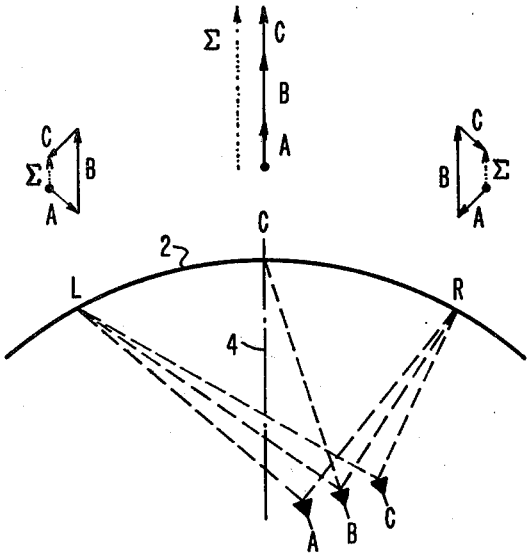
FIGS. 2 and 3 depict schematically in plan view the relative phase relationships of multiple offset feeds at a beam-forming reflector in equally and unequally spaced apart cases, respectively.
Figure 6:
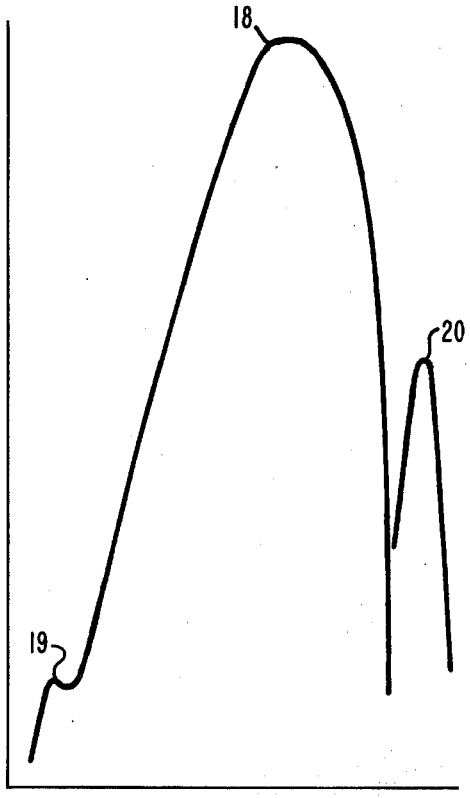
FIGS. 6 and 7 are radiation intensity curves showing the different levels of sidelobe generation in an off-axis fed reflector where equally spaced feed elements are employed in the one case and the unequally spaced ones of the present invention in the other case; and, FIG. 8 shows in three-dimensional front elevation the spacing relationships of a particular slot fed offset antenna assembly found to operate successfully in accord with the present invention.

In order to attempt to control the shape of the beam created by the offset feed means 3 radiating energy to the parabolic reflector 2, it was contemplated that by using a plurality of feed elements A, B, C spaced apart laterally relative to one another, the sidelobes resulting from the offset aspect of such feed means might be controlled. Vertical spacing also has been employed in the feed element array, but insofar as the present invention is concerned, such vertical spacing aspects may be ignored. At first the feed elements A, B, C were spaced apart equally horizontally, and each element or vertical rows of elements A, B, C illuminated the same horizontal segment of the reflector, as shown in FIG. 2. The vector diagrams for the three feed locations A, B, C appear above the left L, center C, and right R sites on the reflector 2, such sites being relative to the focal axis 4 of the reflector. It will be noted that the summation vectors $\Sigma$ in each of the three vector diagrams are parallel to one another, hence are in phase, and hence have no compensating effect on the sidelobe signal level affiliated with the main beam. In FIG. 6 a main beam lobe 18 is depicted together with a pair of unequal sidelobes 19 and 20, which latter has been measured in one equal horizontal spacing case to be only 19.8 db below the main lobe intensity at intended operating parameters.

Figure 3:
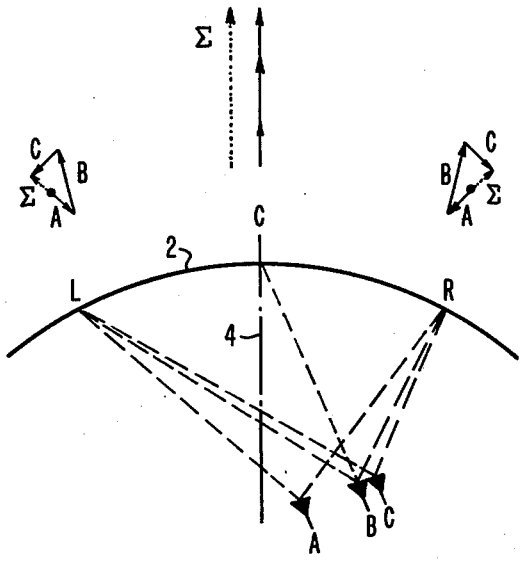
Figure 7:
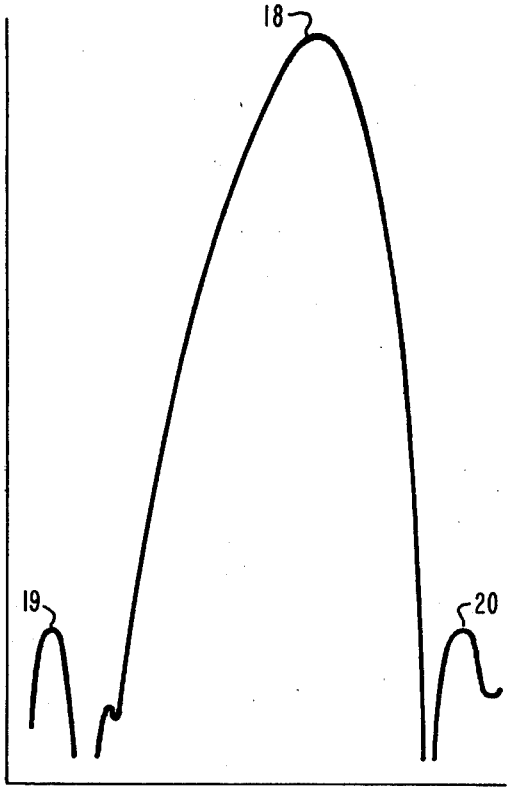
Figure 8:
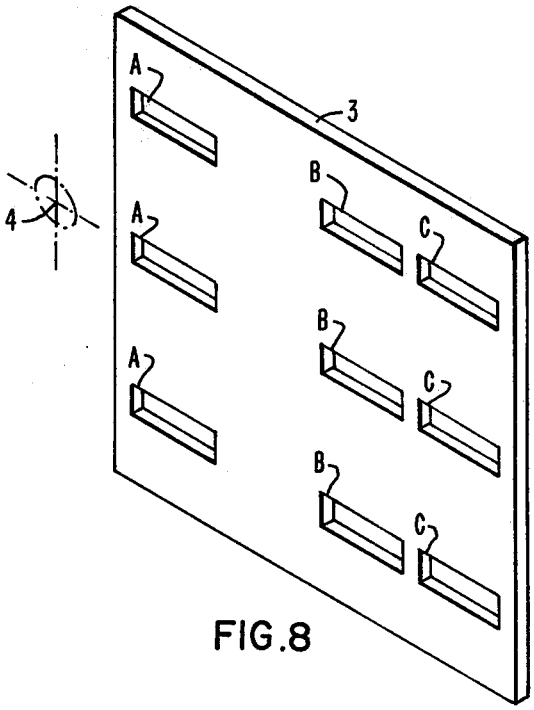

Varying the horizontal spacing between the feed elements A, B, C or vertical rows of feed elements A, B, C was experimented with in order to affect the relative phasing of the signals from these elements as same appear at the reflector 2, such as depicted schematically and by vector diagram in FIG. 3, where it will be noted that the summation vectors Σ at each of the left, center, and right locations L, C, and R each point in different directions. Again, as in the equal spacing situation of FIG. 2, the horizontal radiation from the three feed element sites A, B, C illuminate the same horizontal segment of the reflector. In this unequal element spacing case, however, sidelobe suppression was obtained as a result of such phasing differences, and by use of test measurements an optimum horizontal spacing for a particular three-by-three nine element array at 1060 MHz was determined to be at nine, sixteen and three tenths, and twenty-one inches from the central focal axis 4 of the reflector 2; such relative spacing for such an array being depicted in FIGS. 1 and 8. The extent of sidelobe suppression in this latter case being as depicted in FIG. 7, where the sidelobes 19 and 20 are made equal and reduced in intensity from the main beam lobe 18 by such as thirty-seven db in one case.

The magnitude of the horizontal displacement of the center element or elements B from a mid-position between elements A and C is typically 5% of the mid-position spacing distance, depending on the exact reflector 2 shape and feed array geometry.

Because of the complex relationships involved, the most practical procedure is to adjust such displacement under computer simulation of the complete antenna assembly, or under test.

I claim:

1. An antenna assembly comprising, a reflector having a surface curvature to concentrate microwave energy at a localized region intermediate its ends thereof to provide a focal axis intermediate its ends for forming a beam of electromagnetic wave energy thereon, a first feed means positioned in direct alignment with said focal axis, and second feed means for such energy positioned at one side of said focal axis, said second feed means including an array of horizontal rows of feed elements positioned at said one side to illuminate a common horizontal segment of said reflector on the focal axis and at opposite sides of said focal axis, at least certain of said rows of feed elements being horizontally spaced apart selected unequal distances from each other at said one side of the focal axis, said distance being selected such that the summation vectors of the beam reflected from said one side of said focal axis point in a different direction than the summation vectors of the beam reflected from the opposite side of said focal axis and the summation vectors of both said beams point in different directions than the beam reflected from the focal axis for reducing sidelobe content of such beam.

2. The antenna assembly of claim 1, wherein said array has three rows of feed elements, the intermediate one of which is closer to the row furthest from the aforesaid focal axis.

3. The antenna assembly of claim 2, wherein there are three feed elements in each row.

4. The antenna assembly of claim 2 wherein separation distances of the three rows from the focal axis are substantially nine, sixteen and three tenths, and twenty-one inches, respectively.

* * * * *